US007591455B2

(12) United States Patent
Terao et al.

(10) Patent No.: US 7,591,455 B2
(45) Date of Patent: Sep. 22, 2009

(54) SHEET FINISHING APPARATUS

(75) Inventors: Yasunobu Terao, Shizuoka-ken (JP); Hajime Yamamoto, Shizuoka-ken (JP); Yoshiaki Sugizaki, Shizuoka-ken (JP); Tomomi Iijima, Shizuoka-ken (JP); Hiroyuki Taki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/048,413

(22) Filed: Mar. 14, 2008

(65) Prior Publication Data

US 2008/0211161 A1 Sep. 4, 2008

Related U.S. Application Data

(63) Continuation of application No. 11/085,625, filed on Mar. 22, 2005, now abandoned.

(51) Int. Cl.
*B65H 37/04* (2006.01)

(52) U.S. Cl. ..... 270/58.11; 270/58.08; 270/58.12; 270/58.13; 270/58.14; 270/58.18

(58) Field of Classification Search ..... 270/58.08, 270/58.11, 58.12, 58.13, 58.14, 58.18; 271/189, 271/190, 191, 192; 399/410
See application file for complete search history.

(56) References Cited

U.S. PATENT DOCUMENTS

| | | | |
|---|---|---|---|
| 4,473,425 | A | 9/1984 | Baughman et al. |
| 4,611,741 | A | 9/1986 | Wilson |
| 4,667,208 | A | 5/1987 | Shiraki et al. |
| 4,794,859 | A | 1/1989 | Huseby et al. |
| 4,849,796 | A | 7/1989 | Murakami |
| 4,878,656 | A | 11/1989 | Honjo et al. |
| 4,898,374 | A | 2/1990 | Vermaat |
| 4,917,366 | A | 4/1990 | Murakami et al. |
| 5,020,784 | A | 6/1991 | Asami et al. |
| 5,021,837 | A | 6/1991 | Uto et al. |
| 5,071,112 | A | 12/1991 | Signoretto |
| 5,098,074 | A | 3/1992 | Mandel et al. |
| 5,282,611 | A | 2/1994 | Ueda et al. |

(Continued)

FOREIGN PATENT DOCUMENTS

| | | | |
|---|---|---|---|
| JP | 60-023250 | A | 2/1985 |

(Continued)

OTHER PUBLICATIONS

U.S. Appl. No. 11/008,122, filed Dec. 10, 2004, Sasahara.

(Continued)

*Primary Examiner*—Gene Crawford
*Assistant Examiner*—Leslie A Nicholson, III
(74) *Attorney, Agent, or Firm*—Foley & Lardner LLP

(57) ABSTRACT

In a sheet finishing apparatus of the present invention, when temporarily loading a plurality of sheets of paper on a standby tray until a processing tray finishes processing, to prevent a sheet of paper loaded first from being pressed out by a sheet of paper ejected later, a chuck for retaining the rear ends of the sheets of paper is installed on the downstream side of the standby tray, and for curled sheets of paper, a standby tray guide and an arm member for suppressing curling of the central part of the sheets of paper are installed, thus matching on the standby tray is stabilized.

18 Claims, 14 Drawing Sheets

U.S. PATENT DOCUMENTS 5,285,249 A 2/1994 Mahoney
5,289,251 A 2/1994 Mandel et al.
5,337,134 A 8/1994 Sato et al.
5,370,384 A 12/1994 Romanowski
5,418,606 A 5/1995 Kikuchi et al.
5,435,544 A 7/1995 Mandel
5,449,157 A 9/1995 Kawano et al.
5,451,037 A 9/1995 Lundstrom
5,590,871 A 1/1997 Okabe et al.
5,622,359 A 4/1997 Kawano et al.
5,628,502 A 5/1997 Amarakoon
5,640,232 A 6/1997 Miyake et al.
5,676,517 A 10/1997 Lotz
5,709,376 A 1/1998 Ushirogata
5,767,884 A 6/1998 Bortolotti et al.
5,934,140 A 8/1999 Jackson et al.
5,961,274 A 10/1999 Bors
5,971,384 A 10/1999 Asao
6,022,011 A 2/2000 Hirose
6,065,747 A 5/2000 Khovaylo et al.
6,092,948 A 7/2000 Altfather
6,102,385 A 8/2000 Wakamatsu et al.
6,120,020 A 9/2000 Asao
6,142,461 A 11/2000 Asao et al.
6,145,828 A 11/2000 Arai
6,146,085 A 11/2000 Namba et al.
6,179,287 B1 1/2001 Watanabe et al.
6,231,039 B1 5/2001 Chung
6,330,999 B2 12/2001 Coombs et al.
6,336,630 B1 1/2002 Holtman et al.
6,354,059 B1 3/2002 Yoshie et al.
6,357,753 B1 3/2002 Yamasaki et al.
6,371,472 B1 4/2002 Miyake et al.
6,450,934 B1 9/2002 Coombs
6,505,829 B2 1/2003 Kawata
6,550,763 B2 4/2003 Gordon et al.
6,581,922 B2 6/2003 Kuwata et al.
6,600,885 B2 7/2003 Kida
6,641,129 B2 11/2003 Ogita et al.
6,659,455 B2 12/2003 Endo et al.
6,671,492 B2 12/2003 Mimura et al.
6,674,983 B2 1/2004 Enomoto et al.
6,698,744 B2 3/2004 Yamada et al.
6,712,349 B2 3/2004 Watanabe
6,722,646 B2 4/2004 Sekiyama et al.
6,722,650 B1 4/2004 Abbata et al.
6,733,006 B2 5/2004 Kobayashi et al.
6,733,007 B2 5/2004 Sekiyama et al.
6,767,012 B2 7/2004 Sasamoto
6,819,906 B1 11/2004 Herrmann et al.
6,824,128 B2 11/2004 Nagata et al.
6,848,685 B2 2/2005 Katsuyama
6,871,042 B2 3/2005 Nemura et al.
6,910,686 B2 6/2005 Awano
6,928,259 B2 8/2005 Sakuma
6,988,728 B2 1/2006 Kida
7,104,538 B1 9/2006 Kimura et al.
2002/0047233 A1 4/2002 Coombs et al.
2002/0053766 A1 5/2002 Kubota
2002/0074708 A1 6/2002 Nagata et al.
2002/0163119 A1 11/2002 Kawata
2003/0057625 A1 3/2003 Kuwata et al.
2003/0155705 A1 8/2003 Sekiyama et al.
2003/0214090 A1 11/2003 Kato et al.
2004/0032073 A1 2/2004 Sasamoto
2004/0113348 A1 6/2004 Awano
2004/0126163 A1 7/2004 Asami et al.
2004/0181308 A1 9/2004 Hayashi et al.
2005/0000336 A1 1/2005 Hattori et al.
2006/0067766 A1 3/2006 Terao et al.

FOREIGN PATENT DOCUMENTS

JP 61-078162 U 5/1986
JP 61-108588 A 5/1986
JP 61-021481 Y2 6/1986
JP 61-166470 A 7/1986
JP 62-008965 A 1/1987
JP 62-229126 A 10/1987
JP 63-035756 U 3/1988
JP 63-154578 A 6/1988
JP 63-180673 A 7/1988
JP 63-180660 U 11/1988
JP 02-055369 A 2/1990
JP 03-088667 A 4/1991
JP 04-125248 A 4/1992
JP 04-079857 U 7/1992
JP 04-312894 A 11/1992
JP 04-354756 A 12/1992
JP 05-238103 A 9/1993
JP 06-064815 A 3/1994
JP 06-051970 U 7/1994
JP 06-094324 B2 11/1994
JP 08-026558 A 1/1996
JP 08-259073 A 10/1996
JP 09-124216 A 5/1997
JP 09-216772 A 8/1997
JP 09-309659 A 12/1997
JP 10-095563 A 4/1998
JP 10-279169 A 10/1998
JP 10-324449 A 12/1998
JP 11-011786 A 1/1999
JP 11-043257 A 2/1999
JP 11-147641 A 6/1999
JP 11-157729 A 6/1999
JP 11-208967 A 8/1999
JP 11-231753 A 8/1999
JP 11-301912 A 11/1999
JP 2000-095420 A 4/2000
JP 2000-159414 A 6/2000
JP 2001-048411 A 2/2001
JP 2001-089009 A 4/2001
JP 2001-316029 A 11/2001
JP 2002-060118 A 2/2002
JP 2002-308509 A 10/2002
JP 2002-321862 A 11/2002
JP 2002-362825 A 12/2002
JP 2003-081517 A 3/2003
JP 2003-171057 A 6/2003
JP 2003-192210 A 7/2003
JP 2003-246536 A 9/2003
JP 2003-335450 A 11/2003
JP 2004-142868 A 5/2004
JP 4164058 B2 8/2008

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.

U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
C. Iizuka et al., U.S. PTO Office Action, U.S. Appl. No. 11/085,251, Jun. 25, 2007, 28 pgs.
C. Iizuka et al., U.S. PTO Office, U.S. Appl. No. 11/085,251, Oct. 16, 2007, 10 pages.
K. Sasahara et al., U.S. PTO Office Action, U.S. Appl. No. 11/008,122, Apr. 19, 2006, 10 pages.
Y. Terao et al., Notice of Allowance and Fee(s) Due, U.S. Appl. No. 11/008,131, Sep. 26, 2007, 12 pages.
Y. Terao et al., Notice of Allowance and Fee(s) Due, U.S. Appl. No. 11/008,132, Jun. 1, 2007, 11 pgs.
Y. Terao et al., Notice of Allowance and Fee(s) Due, U.S. Appl. No. 11/008,132, Oct. 6, 2005, 9 pages.
Y. Terao et al., Notice of Allowance and Fee(s) Due, U.S. Appl. No. 11/008,142, Jan. 5, 2007, 24 pages.
Y. Terao et al., Notice of Allowance and Fee(s) Due, U.S. Appl. No. 11/008,145, Dec. 14, 2006, 20 pages.
Y. Terao et al., Notice of Allowance and Fee(s) Due, U.S. Appl. No. 11/008,147, Nov. 17, 2006, 7 pages.
Y. Terao et al., Notice of Allowance and Fee(s) Due, U.S. Appl. No. 11/008,148, Jun. 26, 2006, 10 pages.
Y. Terao et al., Notice of Allowance and Fee(s) Due, U.S. Appl. No. 11/008,199, Jan. 16, 2008, 8 pages.
Y. Terao et al., Notice of Allowance and Fee(s) Due, U.S. Appl. No. 11/008,199, Apr. 20, 2006, 15 pages.
Y. Terao et al., Notice of Allowance and Fee(s) Due, U.S. Appl. No. 11/008,247, May 1, 2006, 16 pages.
Y. Terao et al., Notice of Allowance and Fee(s) Due, U.S. Appl. No. 11/008,251, Jun. 26, 2006, 10 pages.
Y. Terao et al., Notice of Allowance and Fee(s) Due, U.S. Appl. No. 11/008,290, Aug. 2, 2007, 9 pages.
Y. Terao et al., Notice of Allowance and Fee(s) Due, U.S. Appl. No. 11/008,294, Feb. 6, 2007, 7 pages.
Y. Terao et al., Notice of Allowance and Fee(s) Due, U.S. Appl. No. 11/008,294, Jun. 14, 2007, 6 pages.
Y. Terao et al., Notice of Allowance and Fee(s) Due, U.S. Appl. No. 11/008,295, Sep. 21, 2006, 7 pages.
Y. Terao et al., Notice of Allowance and Fee(s) Due, U.S. Appl. No. 11/008,299, Jul. 23, 2007, 10 pages.
Y. Terao et al., Notice of Allowance and Fee(s) Due, U.S. Appl. No. 11/008,349, May 2, 2005, 9 pages.
Y. Terao et al., Notice of Allowance and Fee(s) Due, U.S. Appl. No. 11/008,350, Sep. 21, 2006, 7 pages.
Y. Terao et al., Notice of Allowance and Fee(s) Due, U.S. Appl. No. 11/008,381, Feb. 22, 2007, 23 pages.
Y. Terao et al., Notice of Allowance and Fee(s) Due, U.S. Appl. No. 11/008,381, Jun. 29, 2007, 6 pgs.
Y. Terao et al., Notice of Allowance and Fee(s) Due, U.S. Appl. No. 11/008,392, Sep. 15, 2006, 10 pages.
Y. Terao et al., Notice of Allowance and Fee(s) Due, U.S. Appl. No. 11/008,567, Mar. 1, 2007, 6 pages.
Y. Terao et al., Notice of Allowance and Fee(s) Due, U.S. Appl. No. 11/085,240, Jul. 24, 2007, 20 pages.
Y. Terao et al., Notice of Allowance and Fee(s) Due, U.S. Appl. No. 11/085,241, Jun. 26, 2006, 10 pages.
Y. Terao et al., Notice of Allowance and Fee(s) Due, U.S. Appl. No. 11/085,242, Nov. 7, 2007, 10 pages.
Y. Terao et al., Notice of Allowance and Fee(s) Due, U.S. Appl. No. 11/085,243, Jun. 26, 2006, 10 pages.
Y. Terao et al., Notice of Allowance and Fee(s) Due, U.S. Appl. No. 11/085,244, Jul. 13, 2006, 10 pages.
Y. Terao et al., Notice of Allowance and Fee(s) Due, U.S. Appl. No. 11/085,247, Feb. 28, 2007, 14 pages.
Y. Terao et al., Notice of Allowance and Fee(s) Due, U.S. Appl. No. 11/085,248, Aug. 16, 2007, 8 pages.
Y. Terao et al., Notice of Allowance and Fee(s) Due, U.S. Appl. No. 11/085,257, Oct. 31, 2007, 8 pages.
Y. Terao et al., U.S. PTO Notice of Allowance, U.S. Appl. No. 11/085,243, Jan. 5, 2006, with attached Notice of Withdrawal from Issue dated Jan. 10, 2006, 10 pgs.
Y. Terao et al., U.S. PTO Office Action, U.S. Appl. No. 11/008,122, Nov. 21, 2005, 9 pages.
Y. Terao et al., U.S. PTO Office Action, U.S. Appl. No. 11/008,131, Feb. 8, 2007, 22 pages.
Y. Terao et al., U.S. PTO Office Action, U.S. Appl. No. 11/008,131, Feb. 23, 2006, 9 pgs.
Y. Terao et al., U.S. PTO Office Action, U.S. Appl. No. 11/008,131, Oct. 17, 2006, 15 pages.
Y. Terao et al., U.S. PTO Office Action, U.S. Appl. No. 11/008,132, Jun. 9, 2006, with attached Notice of Withdrawal from Issue dated May 30, 2006, 11 pgs.
Y. Terao et al., U.S. PTO Office Action, U.S. Appl. No. 11/008,132, Nov. 24, 2006, 16 pages.
Y. Terao et al., U.S. PTO Office Action, U.S. Appl. No. 11/008,145, Jun. 30, 2006, 6 pgs.
Y. Terao et al., U.S. PTO Office Action, U.S. Appl. No. 11/008,147, Jul. 7, 2006, 4 pgs.
Y. Terao et al., U.S. PTO Office Action, U.S. Appl. No. 11/008,148, Jan. 11, 2006, 12 pages.
Y. Terao et al., U.S. PTO Office Action, U.S. Appl. No. 11/008,199, Aug. 30, 2007, 18 pages.
Y. Terao et al., U.S. PTO Office Action, U.S. Appl. No. 11/008,222, Feb. 24, 2006, 12 pgs.
Y. Terao et al., U.S. PTO Office Action, U.S. Appl. No. 11/008,224, Feb. 28, 2007, 11 pages.
Y. Terao et al., U.S. PTO Office Action, U.S. Appl. No. 11/008,224, Apr. 21, 2006, 12 pages.
Y. Terao et al., U.S. PTO Office Action, U.S. Appl. No. 11/008,224, Aug. 28, 2007, 8 pages.
Y. Terao et al., U.S. PTO Office Action, U.S. Appl. No. 11/008,224, Nov. 17, 2006, 13 pages.
Y. Terao et al., U.S. PTO Office Action, U.S. Appl. No. 11/008,224, Nov. 21, 2005, 9 pages.
Y. Terao et al., U.S. PTO Office Action, U.S. Appl. No. 11/008,224, Dec. 14, 2007, 9 pgs.
Y. Terao et al., U.S. PTO Office Action, U.S. Appl. No. 11/008,230, Feb. 24, 2006, 11 pgs.
Y. Terao et al., U.S. PTO Office Action, U.S. Appl. No. 11/008,230, Nov. 13, 2006, 17 pages.
Y. Terao et al., U.S. PTO Office Action, U.S. Appl. No. 11/008,248, Jan. 8, 2007, 25 pgs.
Y. Terao et al., U.S. PTO Office Action, U.S. Appl. No. 11/008,248, Aug. 22, 2007, 8 pgs.
Y. Terao et al., U.S. PTO Office Action, U.S. Appl. No. 11/008,251, Jan. 13, 2006, 11 pages.
Y. Terao et al., U.S. PTO Office Action, U.S. Appl. No. 11/008,257, Apr. 28, 2006, 13 pages.
Y. Terao et al., U.S. PTO Office Action, U.S. Appl. No. 11/008,257, Nov. 30, 2005, 9 pages.
Y. Terao et al., U.S. PTO Office Action, U.S. Appl. No. 11/008,271, Apr. 25, 2006, 14 pages.
Y. Terao et al., U.S. PTO Office Action, U.S. Appl. No. 11/008,271, Nov. 30, 2005, 9 pages.

Y. Terao et al., U.S. PTO Office Action, U.S. Appl. No. 11/008,290, Jul. 21, 2006, 15 pgs.
Y. Terao et al., U.S. PTO Office Action, U.S. Appl. No. 11/008,290, Nov. 30, 2005, 9 pages.
Y. Terao et al., U.S. PTO Office Action, U.S. Appl. No. 11/008,294, May 5, 2006, 13 pages.
Y. Terao et al., U.S. PTO Office Action, U.S. Appl. No. 11/008,294, Oct. 24, 2006, 11 pages.
Y. Terao et al., U.S. PTO Office Action, U.S. Appl. No. 11/008,295, Jan. 5, 2006, 11 pages.
Y. Terao et al., U.S. PTO Office Action, U.S. Appl. No. 11/008,295, Jun. 23, 2006, 14 pgs.
Y. Terao et al., U.S. PTO Office Action, U.S. Appl. No. 11/008,299, May 5, 2006, 12 pages.
Y. Terao et al., U.S. PTO Office Action, U.S. Appl. No. 11/008,350, Jan. 26, 2006, 12 pages.
Y. Terao et al., U.S. PTO Office Action, U.S. Appl. No. 11/008,350, Jul. 6, 2006, 12 pgs.
Y. Terao et al., U.S. PTO Office Action, U.S. Appl. No. 11/008,381, Aug. 23, 2006, 17 pages.
Y. Terao et al., U.S. PTO Office Action, U.S. Appl. No. 11/008,392, Apr. 26, 2006, 10 pages.
Y. Terao et al., U.S. PTO Office Action, U.S. Appl. No. 11/008,392, Dec. 14, 2005, 9 pages.
Y. Terao et al., U.S. PTO Office Action, U.S. Appl. No. 11/008,567, Aug. 21, 2006, 14 pages.
Y. Terao et al., U.S. PTO Office Action, U.S. Appl. No. 11/085,226, Jul. 20, 2006, 12 pages.
Y. Terao et al., U.S. PTO Office Action, U.S. Appl. No. 11/085,226, Jan. 13, 2006, 9 pgs.
Y. Terao et al., U.S. PTO Office Action, U.S. Appl. No. 11/085,226, Jan. 29, 2007, 6 pages.
Y. Terao et al., U.S. PTO Office Action, U.S. Appl. No. 11/085,227, Aug. 11, 2006, 15 pages.
Y. Terao et al., U.S. PTO Office Action, U.S. Appl. No. 11/085,227, Feb. 9, 2006, 9 pgs.
Y. Terao et al., U.S. PTO Office Action, U.S. Appl. No. 11/085,240, Aug. 2, 2006, 15 pages.
Y. Terao et al., U.S. PTO Office Action, U.S. Appl. No. 11/085,240, Jan. 26, 2006, 8 pgs.
Y. Terao et al., U.S. PTO Office Action, U.S. Appl. No. 11/085,241, Feb. 9, 2006, 9 pgs.
Y. Terao et al., U.S. PTO Office Action, U.S. Appl. No. 11/085,242, Jul. 10, 2007, 9 pgs.
Y. Terao et al., U.S. PTO Office Action, U.S. Appl. No. 11/085,243, Jan. 26, 2006, 6 pgs.
Y. Terao et al., U.S. PTO Office Action, U.S. Appl. No. 11/085,244, Feb. 9, 2006, 7 pgs.
Y. Terao et al., U.S. PTO Office Action, U.S. Appl. No. 11/085,247, Jul. 13, 2006, 14 pgs.
Y. Terao et al., U.S. PTO Office Action, U.S. Appl. No. 11/085,248, Jul. 5, 2006, 15 pgs.
Y. Terao et al., U.S. PTO Office Action, U.S. Appl. No. 11/085,248, Oct. 24, 2006, 12 pages.
Y. Terao et al., U.S. PTO Office Action, U.S. Appl. No. 11/085,250, Jun. 20, 2007, 24 pgs.
Y. Terao et al., U.S. PTO Office Action, U.S. Appl. No. 11/085,256, Jul. 13, 2006, 13 pgs.
Y. Terao et al., U.S. PTO Office Action, U.S. Appl. No. 11/085,257, Jul. 16, 2007, 12 pgs.
Y. Terao et al., U.S. PTO Office Action, U.S. Appl. No. 11/085,264, Sep. 12, 2007, 16 pages.
Y. Terao et al., U.S. PTO Office Action, U.S. Appl. No. 11/822,611, Sep. 25, 2007, 20 pages.
Y. Terao et al., U.S. PTO Office Action, U.S. Appl. No. 11/826,731, Jan. 14, 2008, 7 pages.
Y. Terao et al., U.S. PTO Office Action, U.S. Appl. No. 11/826,731, Sep. 13, 2007, 21 pages.
Y. Terao et al., U.S. PTO Office, U.S. Appl. No. 11/008,290, Mar. 9, 2007, 8 pages.
Y. Terao et al., U.S. PTO Office, U.S. Appl. No. 11/008,294, Dec. 13, 2005, 9 pages.
Y. Terao et al., U.S. PTO Office, U.S. Appl. No. 11/008,299, Dec. 13, 2005, 9 pages.
Y. Terao et al., U.S. PTO Office, U.S. Appl. No. 11/008,349, Dec. 13, 2005, 9 pages.
Y. Terao et al., U.S. PTO Office, U.S. Appl. No. 11/008,567, Dec. 13, 2005, 9 pages.
Y. Terao et al., U.S. PTO Office, U.S. Appl. No. 11/085,240, Mar. 12, 2007, 15 pages.
Y. Terao et al., U.S. PTO Office, U.S. Appl. No. 11/085,242, Mar. 23, 2007, 20 pages.
Y. Terao et al., U.S. PTO Office, U.S. Appl. No. 11/085,248, Apr. 10, 2007, 12 pages.
Y. Terao et al., U.S. PTO Office, U.S. Appl. No. 11/085,250, Nov. 20, 2007, 13 pages.
Y. Terao et al., U.S. PTO Office, U.S. Appl. No. 11/085,257, Mar. 23, 2007, 23 pages.
Y. Terao et al., U.S. PTO Office, U.S. Appl. No. 11/085,264, Mar. 23, 2007, 21 pages.
Y. Terao, et al., Notice of Allowance and Fee(s) Due, U.S. Appl. No. 11/008,122, Jul. 26, 2006, 8 pgs.
Y. Terao, et al., Notice of Allowance and Fee(s) Due, U.S. Appl. No. 11/008,124, Sep. 30, 2005, 9 pages.
Y. Terao, et al., Notice of Allowance and Fee(s) Due, U.S. Appl. No. 11/008,222, Aug. 31, 2006, 12 pgs.
Y. Terao, et al., Notice of Allowance and Fee(s) Due, U.S. Appl. No. 11/008,257, Oct. 24, 2006, 11 pgs.
Y. Terao, et al., Notice of Allowance and Fee(s) Due, U.S. Appl. No. 11/008,299, Sep. 6, 2006, 9 pgs.
C. Iizuka et al., Notice of Allowance and Fee(s) Due, U.S. Appl. No. 11/085,251, Apr. 3, 2008, 8 pages.
Y. Terao, et al., Notice of Allowance and Fee(s) Due, U.S. Appl. No. 11/008,248, Apr. 7, 2008, 11 pages.
Y. Terao et al., U.S. PTO Office Action, U.S. Appl. No. 11/008,224, Apr. 14, 2008, 7 pgs.
Y. Terao et al., U.S. PTO Office Action, U.S. Appl. No. 11/085,250, Apr. 10, 2008, 7 pgs.
Y. Terao et al., U.S. PTO Office Action, U.S. Appl. No. 11/882,611, Apr. 21, 2008, 18 pgs.
Y. Terao et al., U.S. PTO Office Action, U.S. Appl. No. 11/976,140, Apr. 29, 2008, 27 pgs.
Y. Terao et al., Notice of Allowance and Fee(s) Due, U.S. Appl. No. 11/826,731, Jun. 13, 2008, 5 pages.
Y. Terao et al., Notice of Allowance and Fee(s) Due, U.S. Appl. No. 11/008,224, Sep. 11, 2008, 9 pages.
Y. Terao et al., Notice of Allowance and Fee(s) Due, U.S. Appl. No. 11/976,140, Oct. 17, 2008, 29 pages.
Y. Terao et al., U.S. PTO Office Action, U.S. Appl. No. 11/822,611, Nov. 13, 2008, 14 pages.
Y. Terao et al., U.S. PTO Office Action, U.S. Appl. No. 11/822,611, Jun. 11, 2009, 12 pgs.

SHEET FINISHING APPARATUS

The present application is a continuation of U.S. application Ser. No. 11/085,625, filed Mar. 22, 2005, the entire contents of which is incorporated herein by reference.

BACKGROUND OF THE INVENTION

1. Field of the Invention

The present invention relates to a sheet finishing apparatus for post-processing sheets of paper ejected from an image forming apparatus such as a copier, a printer, or a composite device.

2. Description of the Related Art

In recent years, there has been an image forming apparatus used in which to perform a post process of sorting and stapling sheets of paper after image forming, a sheet finishing apparatus is installed adjacent to the paper ejection unit of the image forming apparatus body. In such a sheet finishing apparatus, after the end of the post process of a preceding sheet of paper, the post process is performed for a succeeding sheet of paper. To make the succeeding sheet of paper ejected from the image forming apparatus body like this stand by, conventionally, there is an apparatus having a shifting path such as a standby tray installed halfway down the path leading to the stapler.

When temporarily loading a plurality of sheets of paper on the standby tray until the process by the processing tray ends, consideration of preventing a sheet of paper loaded first from being pressed out by a succeeding sheet of paper ejected and surely loading a curled sheet of paper in a poor position on the standby tray in good consistency are required.

DETAILED DESCRIPTION OF THE INVENTION

Throughout this description, the embodiments and examples shown should be considered as exemplars, rather than limitations on the apparatus of the present invention.

Hereinafter, the embodiment of the present invention will be explained in detail with reference to the accompanying drawings.

Figure 1:
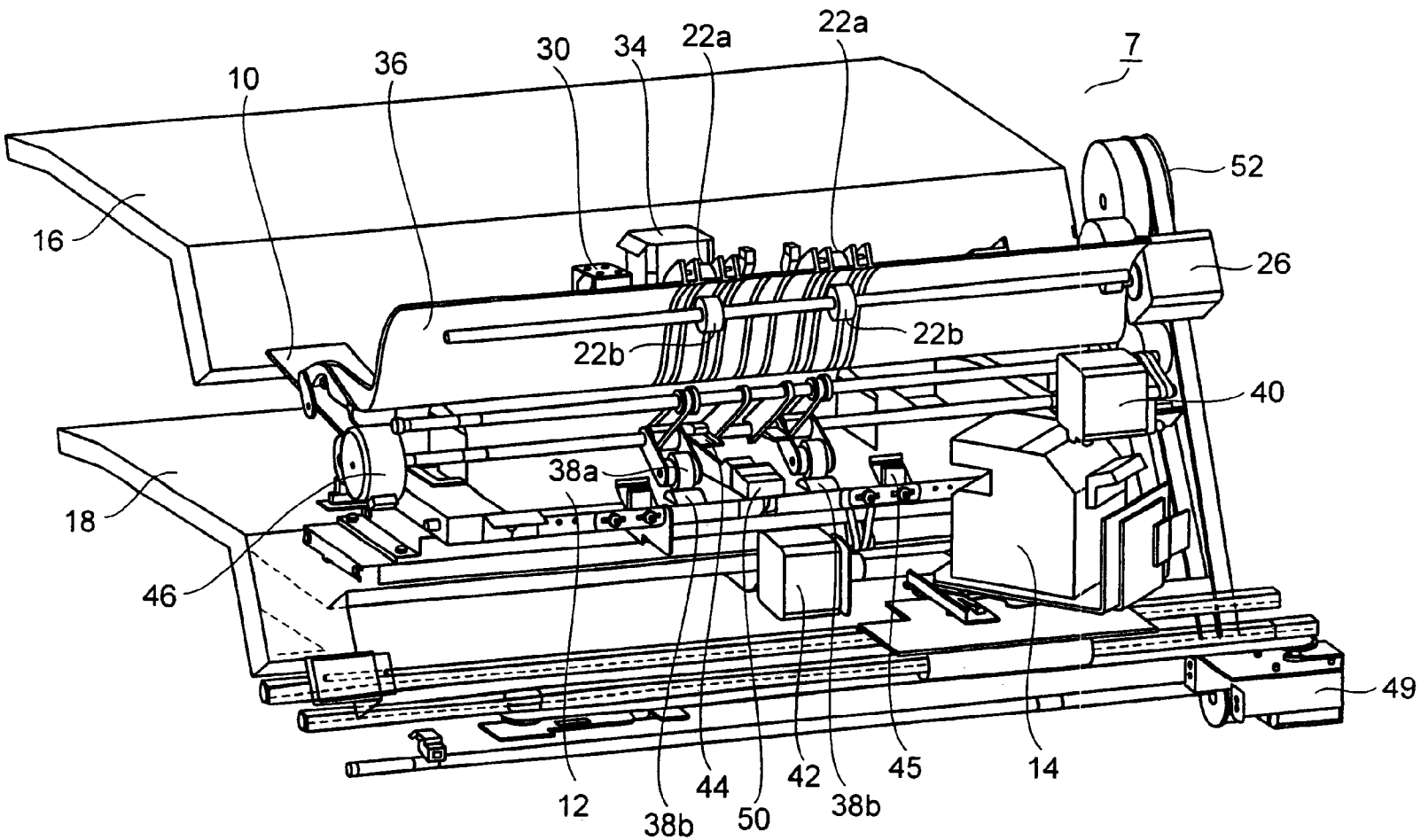
FIG. 1 is a perspective view showing the essential section of the sheet finishing apparatus relating to an embodiment of the present invention.
Figure 2:
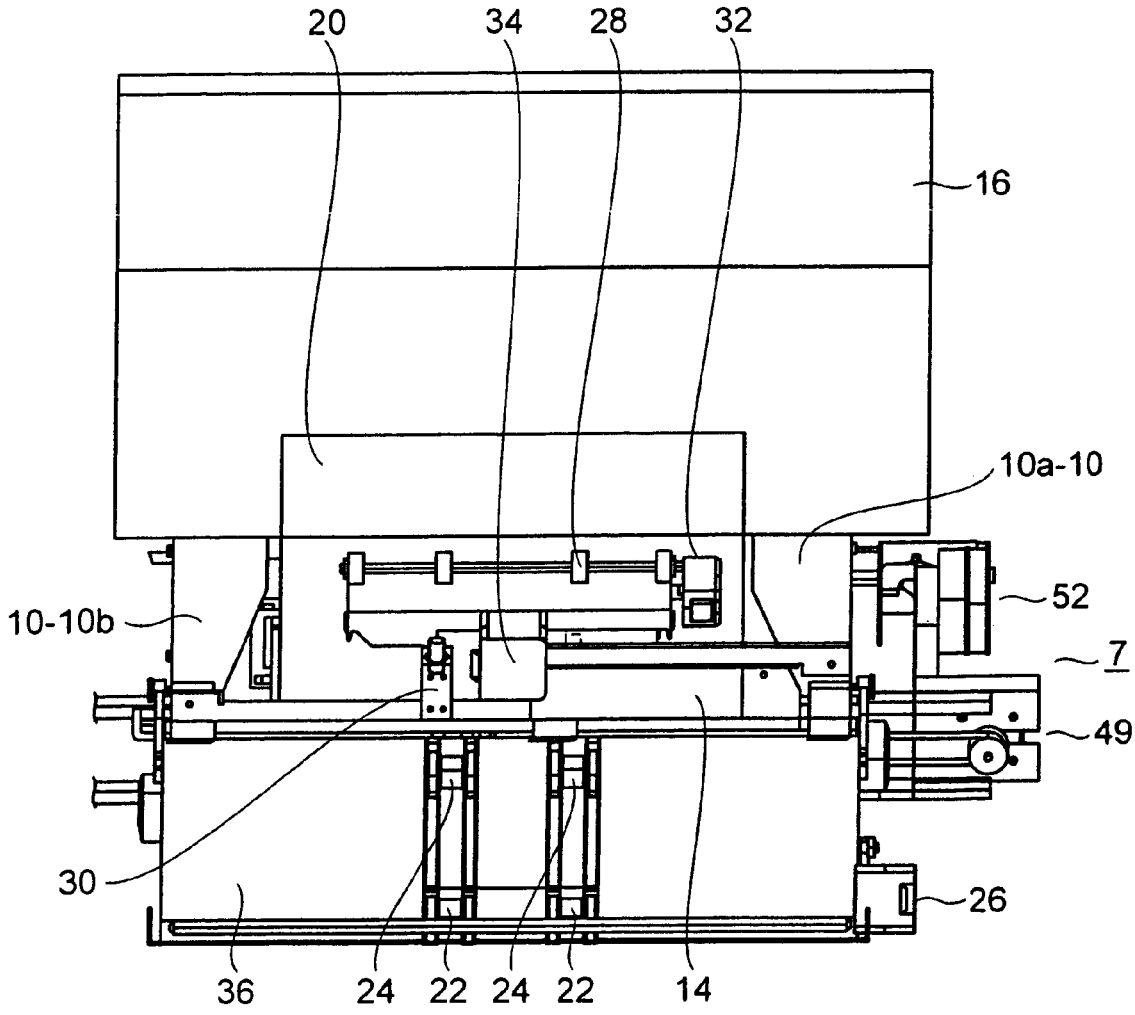
FIG. 2 is a top view showing the essential section of the sheet finishing apparatus relating to an embodiment of the present invention.
Figure 3:
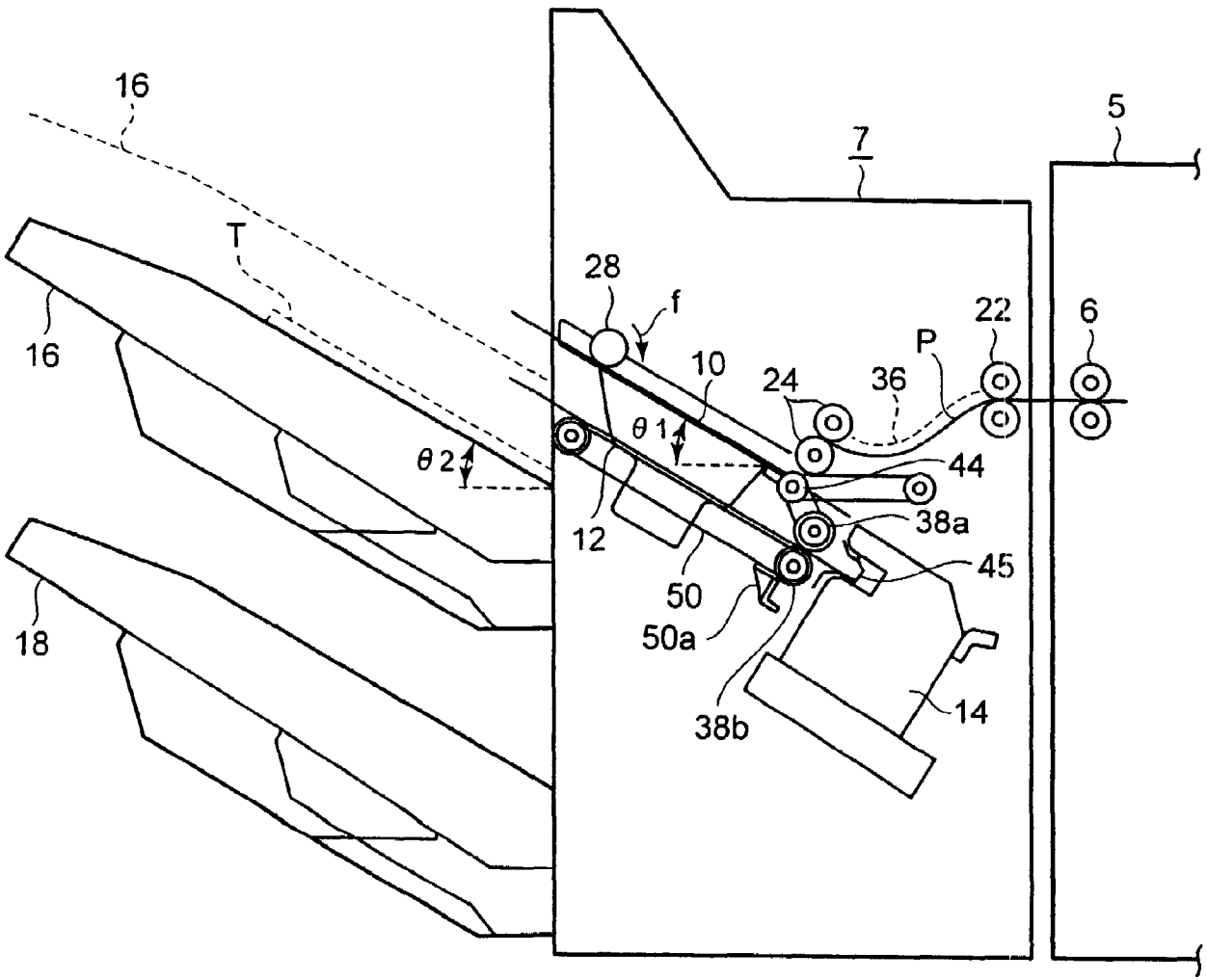
FIG. 3 is a schematic block diagram showing the sheet finishing apparatus relating to an embodiment of the present invention.

Further, in each drawing, to the same parts, the same numerals are assigned and duplicated explanation omitted. FIG. 1 is a perspective view showing the essential section of a sheet finishing apparatus 7 relating to an embodiment of the present invention, and FIG. 2 is a top view showing the essential section of the sheet finishing apparatus relating to an embodiment of the present invention, and FIG. 3 is a schematic block diagram showing the sheet finishing apparatus 7 arranged adjacent to an image forming apparatus 5 such as a copier.

The sheet finishing apparatus 7 is basically composed of a standby tray 10, a processing tray 12, a stapler 14, a first paper ejection tray 16, and a second paper ejection tray 18.

A sheet of paper P, which an image is formed thereon by the image forming apparatus 5 such as a copier and ejected from a pair of paper ejection rollers 6, is received by a pair of inlet rollers 22, is supplied to a pair of paper supply rollers 24, and is sent from the paper supply rollers 24 to the standby tray 10. The inlet rollers 22 are driven by an inlet roller motor 26. Between the inlet rollers 22 and the standby tray 10, a paper path ceiling 36 for leading the sheet of paper P to the paper supply rollers 24 is installed. The inlet rollers 22 are composed of an upper inlet roller 22*a* and a lower inlet roller 22*b*. The paper supply rollers 24 are also composed of an upper paper supply roller and a lower paper supply roller. The standby tray 10 temporarily loads a plurality of sheets of paper P until the processing tray 12 finishes to process the sheets of paper.

Figure 12:
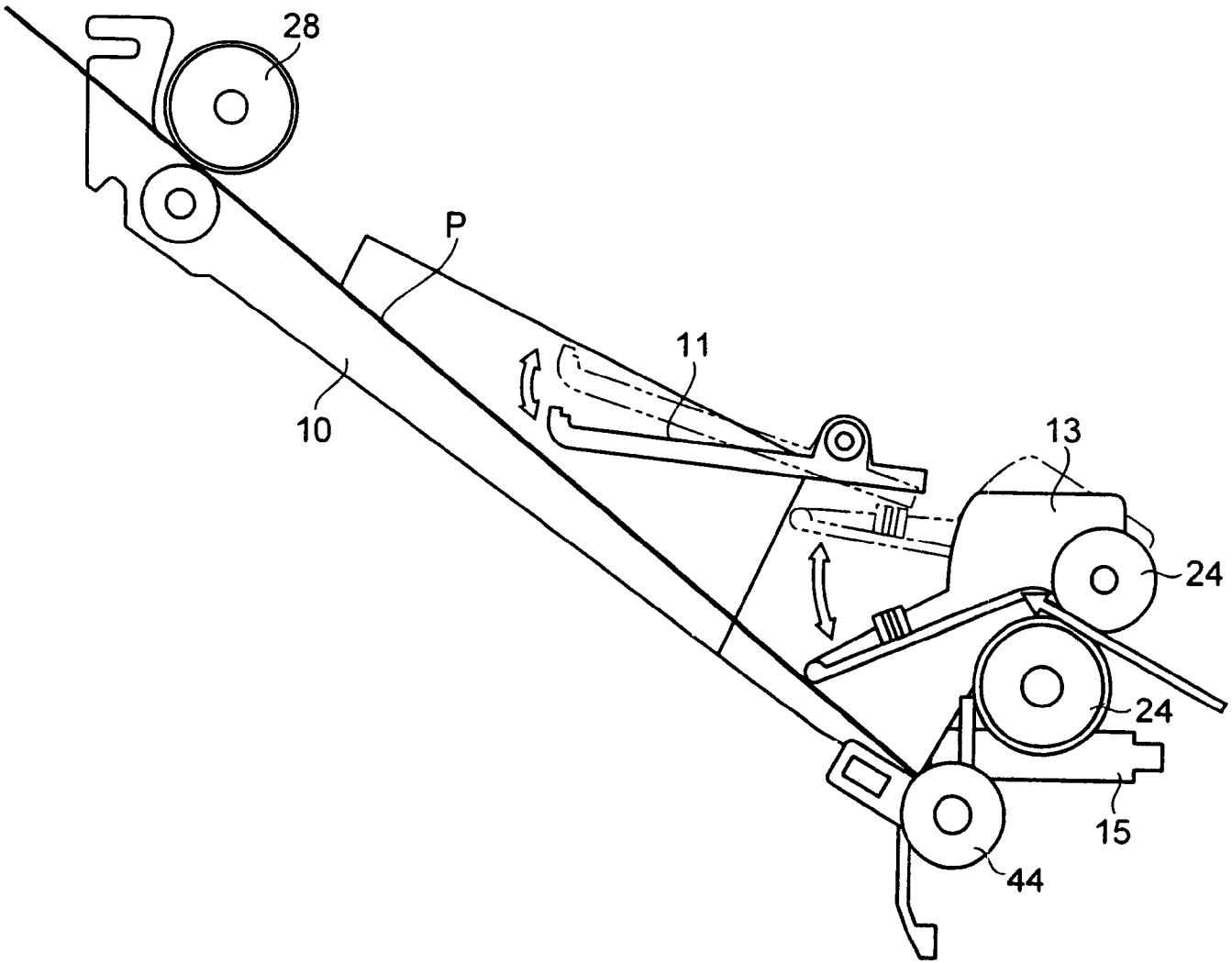
FIG. 12 is an illustration showing the standby tray guide and assist arm relating to an embodiment of the present invention.

As shown in FIG. 12, on the standby tray 10 on the rear end side of the sheet of paper P, a standby tray guide 11 is arranged. The standby tray guide 11 controls the movement and position of sheets of paper P sent from the paper supply rollers 24 to the standby tray 10.

Generally, when a sheet of paper P printed on one side thereof is set with the printed side down, since ink is shrunk, the sheet of paper P is curled upward. Therefore, the standby tray guide 11 is born rotatably on the side of the standby tray 10 and the front end thereof is rounded so as to crush the upward curl of the sheet of paper P.

Furthermore, an assist arm 13 in a lever shape is born rotatably by the mounting shaft of the paper supply rollers 24. The assist arm 13, to prevent the rear end side of a sheet of paper P conveyed powerfully from the paper supply rollers 24 from rising, presses it to the standby tray. The side of the assist arm 13 in contact with the sheet of paper P is formed slightly heavily so as to surely prevent the sheet of paper P from unexpected movement.

Figure 13:
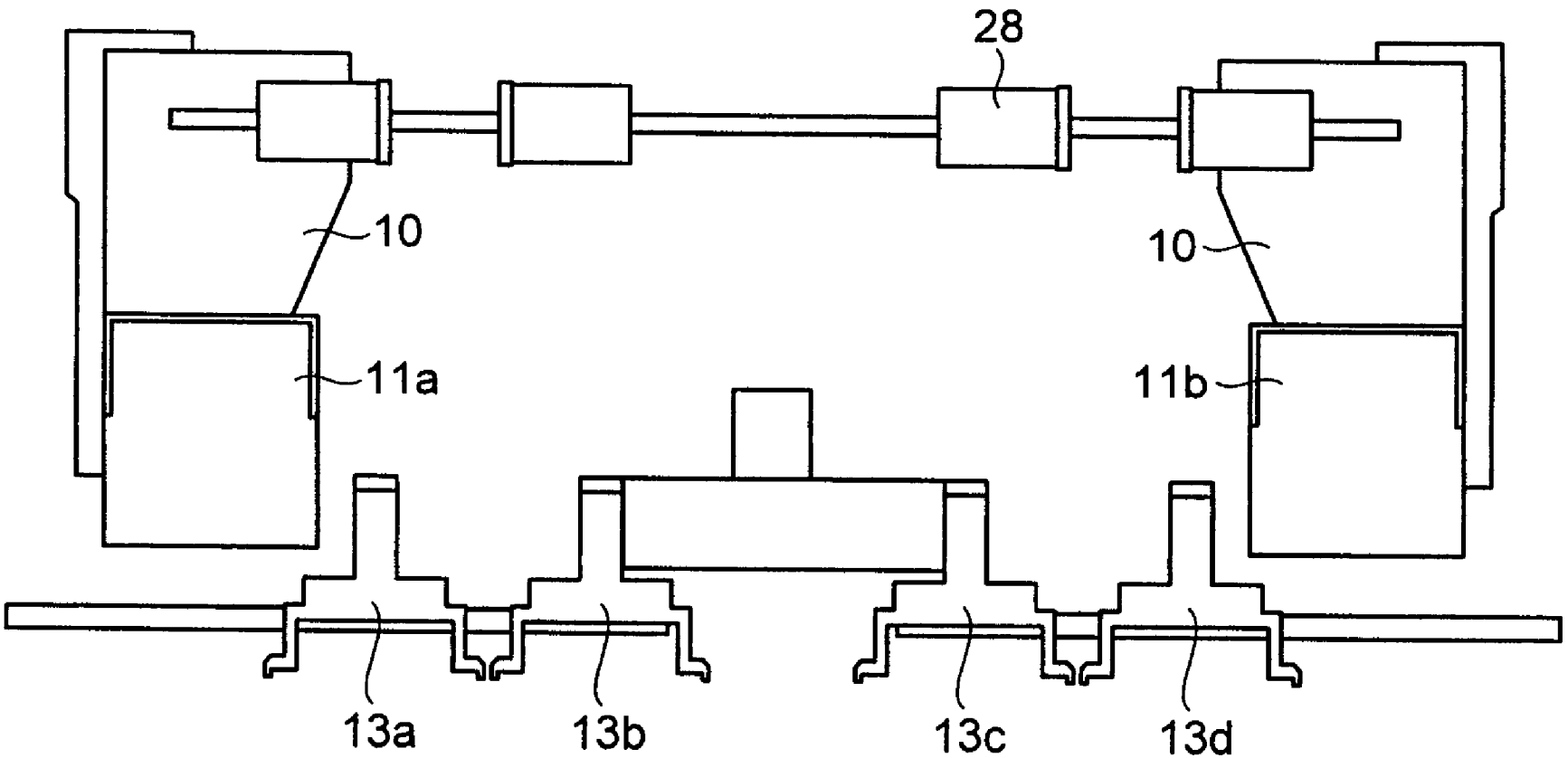
FIG. 13 is an illustration showing an arrangement example of the standby tray guide and assist arm relating to an embodiment of the present invention.

As shown in FIG. 13, the standby tray guide 11 is composed of 11*a* and 11*b* which are arranged right and left almost in accordance with the width of the sheet of paper P. Further, the assist arm 13 composed of four assist arms 13*a*, 13*b*, 13*c*, and 13*d* are installed and arranged between the standby tray guides 11*a* and 11*b* in the drawing. Further, to prevent the assist arms 13 from variations in movement, the adjacent assist arms 13*b* and 13*c* may be connected.

Under the standby tray 10, the processing tray 12 for loading sheets of paper P dropped and supplied from the standby tray 10 is arranged.

The processing tray 12, while sheets of paper P are stapled by the stapler 14 which is a processing mechanism for performing the post process, matches and supports the sheets of paper P to be loaded.

Figure 7:
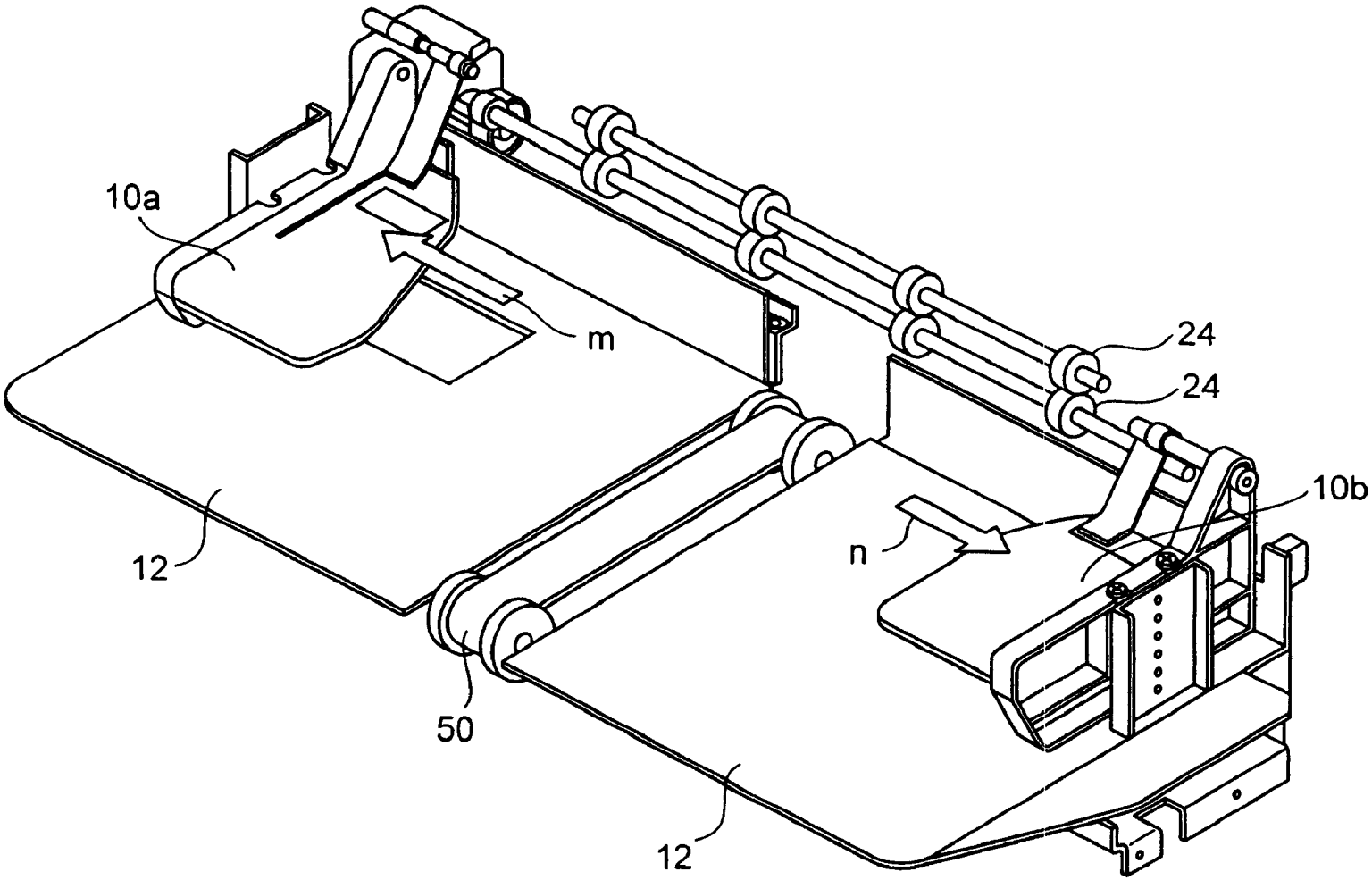
FIG. 7 is a schematic perspective view showing the standby tray and processing tray relating to an embodiment of the present invention.

As shown in FIG. 7, when a predetermined number of sheets of paper is stored in the standby tray 10, standby tray parts 10*a* and 10*b* are opened in the horizontal direction in the drawing by a standby tray motor 34 and the sheets of paper P are dropped on the processing tray 12 by their own weight.

Figure 4:
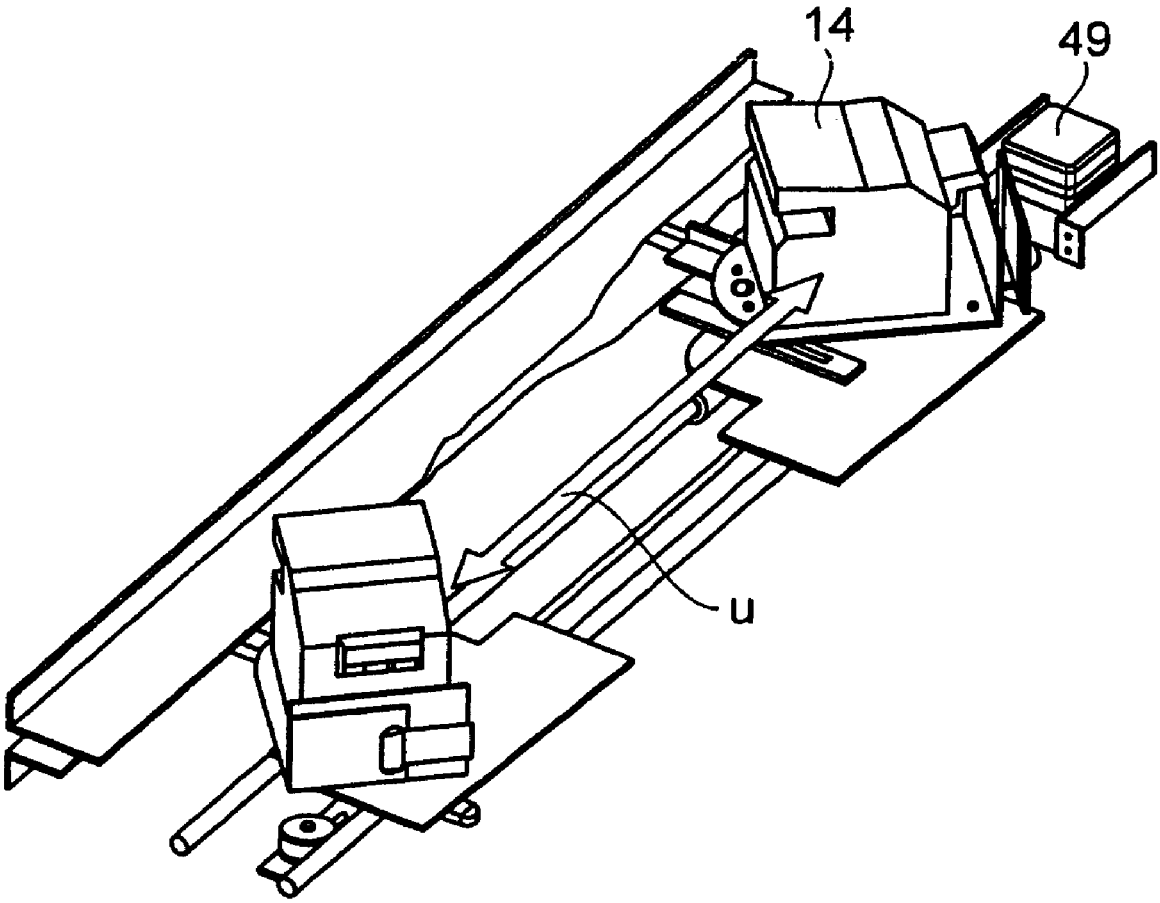
FIG. 4 is a perspective view showing the stapler of the sheet finishing apparatus relating to an embodiment of the present invention.
Figure 5:
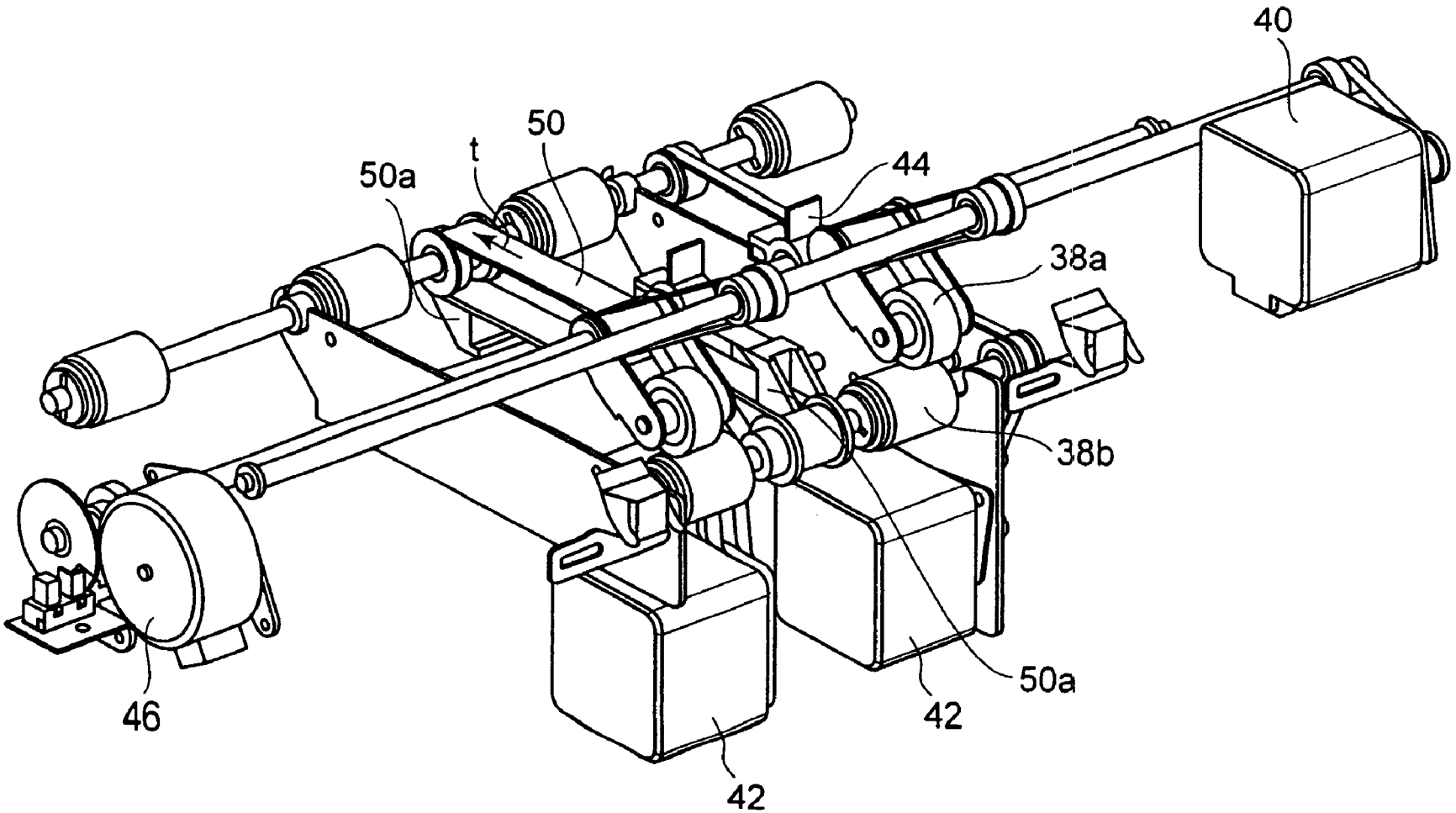
FIG. 5 is a perspective view showing the vertical matching roller relating to an embodiment of the present invention.

As shown in FIG. 4, the stapler 14 is positioned by a stapler driving unit 49 and the stapling process is controlled. The processing tray 12 has a pair of matching rollers; upper vertical matching roller 38*a* and lower vertical matching roller 38*b* shown in FIG. 5 for matching a plurality of sheets of paper P dropped and supplied from the standby tray 10 in the vertical direction which is the conveying direction. The upper and lower vertical matching rollers 38*a* and 38*b* serve as bundle conveying rollers for clamping a sheet bundle T after the end of the stapling process and taking it out from the stapler 14. The upper vertical matching roller 38*a* is driven by a vertical matching upper roller motor 40 and the lower vertical matching roller 38*b* is driven by a vertical matching lower roller motor 42.

Figure 6:
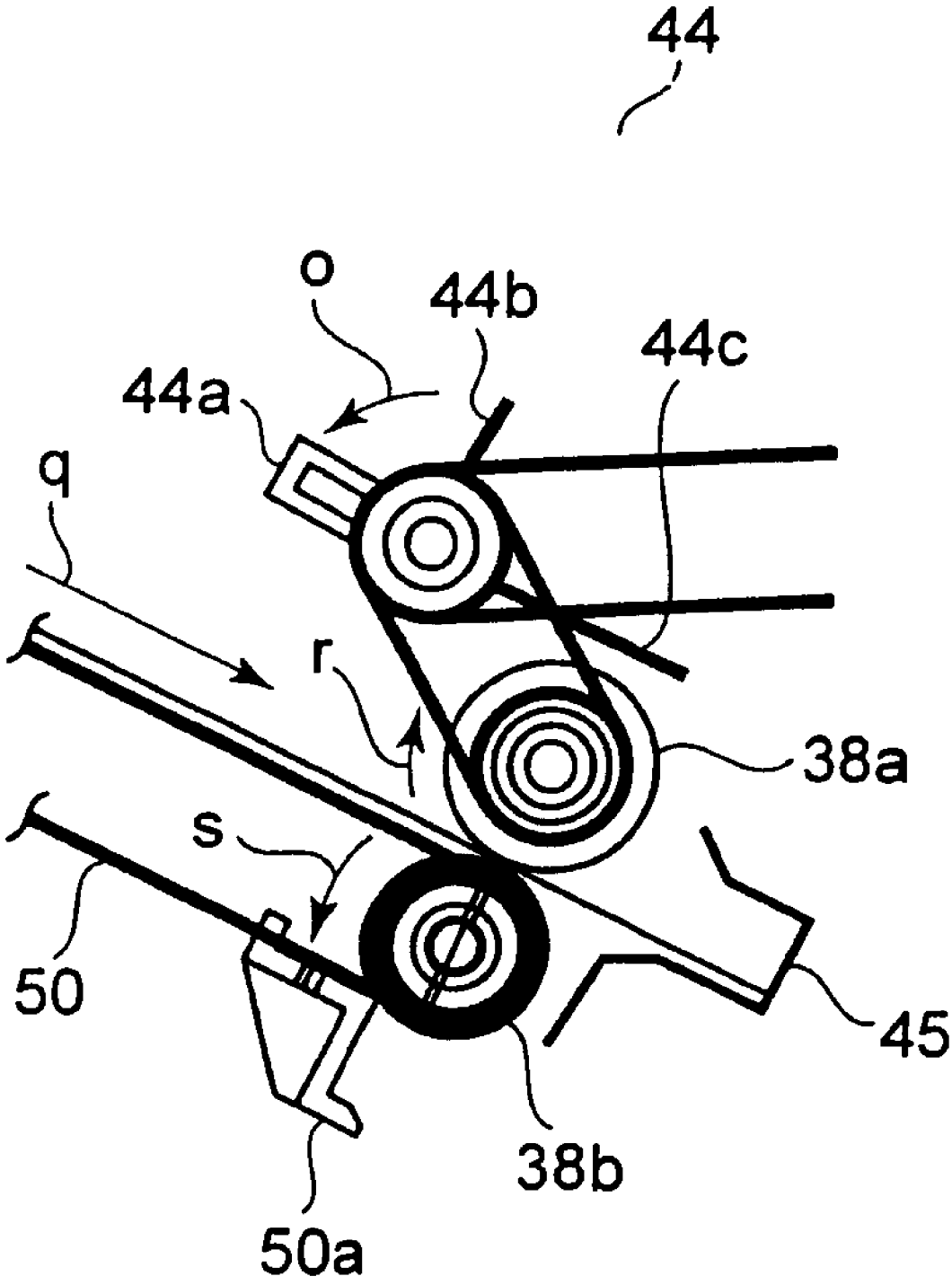
FIG. 6 is an illustration showing the paddle relating to an embodiment of the present invention.

When sheets of paper P are dropped and supplied onto the processing tray 12, at the position where the rear end of each sheet of paper P is dropped, a paddle 44 rotatable for matching the uppermost sheet of paper P loaded on the processing tray 12 in the vertical direction is arranged. The paddle 44, as shown in FIG. 6, has a receiver 44*a* for receiving sheets of paper P dropped and supplied onto the processing tray 12, a tapping portion 44*b* for tapping down sheets of paper P onto the processing tray 12, and a feeder 44*c* for matching sheets of paper P on the processing tray 12 and is driven by a paddle motor 46. The paddle 44 is made of rubber and is elastic.

When temporarily loading a plurality of sheets of paper P on the standby tray until the process by the processing tray ends, a sheet of paper loaded first must be prevented from being pressed out by a succeeding sheet of paper ejected. Further, when a sheet of paper P is curled upward, the paddle 44 runs idle.

Therefore, as shown in FIG. 12, to retain the rear end of the first sheet of paper P at the downstream side part of the standby tray 10, a chuck 15 is installed so as to be positioned between the lower paper supply roller 24 and the paddle 44.

At the end of the processing tray 12 on the side of the stapler 14, a stopper 45 for making contact with the rear end of each sheet of paper P and controlling the rear end position is installed. Almost at the center of the processing tray 12, a conveying belt 50 for conveying a sheet bundle T which is stapled and taken out from the stapler 14 by the upper and lower vertical matching rollers 38*a* and 38*b* to the first or second paper ejection tray 16 or 18 is installed. To the conveying belt 50, a feeding pawl 50*a* for catching the rear end of the sheet bundle T is attached.

The standby tray 10 can drop and supply sheets of paper P to the processing tray 12 and also can convey the sheets of paper P toward the first or second paper ejection tray 16 or 18. Conveying of the sheets of paper P toward the paper ejection trays 16 and 18 is executed by a standby tray roller 28 for matching sheets of paper P making contact with the sheets of paper P on the standby tray 10.

The standby tray roller 28 is controlled to move up and down by a standby tray roller driving source 30 and is driven to rotate by a standby tray roller motor 32.

The standby tray 10 is arranged at an angle of inclination of θ1 so as to support sheets of paper P in a state that the front end of each sheet of paper P is positioned higher than the rear end thereof. The first or second paper ejection tray 16 or 18 is moved up and down by a paper ejection tray driving unit 52 and either of them is selected. The first or second paper ejection tray 16 or 18, when loading sheets of paper P, is moved up or down at an almost same height as that of the standby tray 10 or the processing tray 12 so as to improve the consistency of the posture of sheets of paper P ejected. Further, the first or second paper ejection tray 16 or 18 is arranged at an angle of inclination of θ2 so as to support sheets of paper P in a state that the front end of each sheet of paper P is positioned higher than the rear end thereof.

Figure 8:
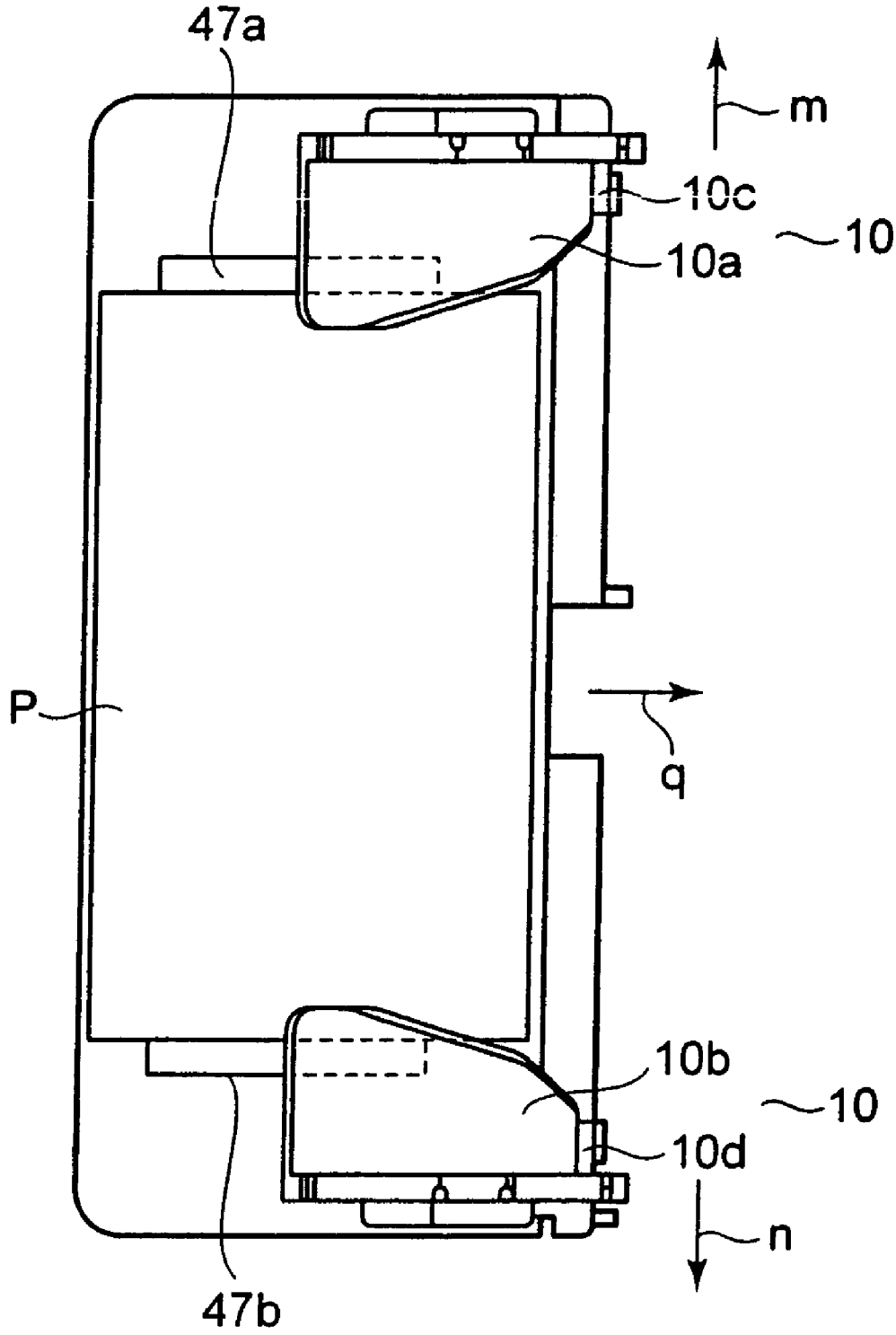
FIG. 8 is a top view showing the standby tray and processing tray relating to an embodiment of the present invention.

As shown in FIGS. 7 and 8, the standby tray 10 has the pair of tray members 10*a* and 10*b* formed so as to project from the wall surface thereof, receives each sheet of paper P by sliding in accordance with the width of the sheet of paper P, and supports both sides of the sheet of paper P. On the tray members 10*a* and 10*b*, standby stoppers 10*c* and 10*d* for controlling the rear end of each sheet of paper P are installed.

Figure 9:
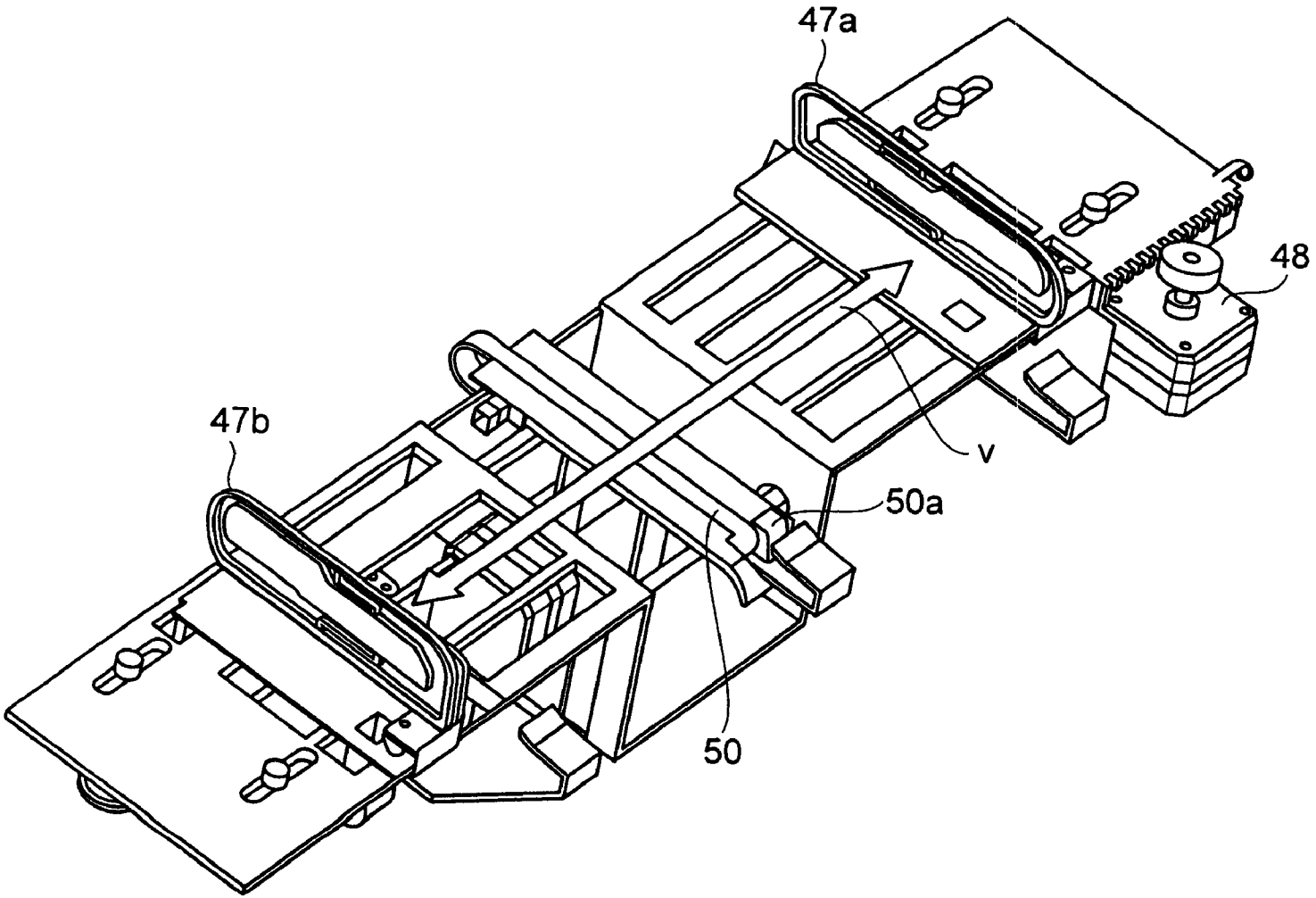
FIG. 9 is a schematic perspective view showing the horizontal matching plate and conveying belt relating to an embodiment of the present invention.

The standby tray 10 is slidden and moved by the standby tray motor 34. Between the standby tray 10 and the processing tray 12, when dropping and supplying sheets of paper P from the standby tray 10 onto the processing tray 12, horizontal matching plates 47*a* and 47*b*, shown in FIG. 9, for horizontally matching the sheets of paper P to prevent them from being disordered in the horizontal direction perpendicular to the conveying direction are installed. The horizontal matching plates 47*a* and 47*b* are formed so as to slide in the direction v in accordance with the width of the sheets of paper P by a horizontal matching motor 48.

Next, the operation of the invention will be described. When an image is formed by the image forming apparatus 5 and a sheet of paper P is supplied from the paper ejection rollers 6, the sheet finishing apparatus 7 performs a different operation depending on execution of the post process of the sheet of paper P or no execution thereof, or during execution of the post process of the preceding sheet of paper P or end of the post process.

When the post process is not performed, for example, the first paper ejection tray 16 slides and moves to the position indicated by the dotted line shown in FIG. 3 and can load sheets of paper ejected from the standby tray 10 in consistent good posture. When the post process is not performed, sheets of paper P conveyed from the inlet roller 22 via the paper path ceiling 36 to the paper supply rollers 24 are supplied to the standby tray 10 by the paper supply rollers 24. Then, the sheets of paper P are conveyed by the standby tray roller 28 moved down onto the standby tray 10 and rotated in the direction of the arrow f and are ejected to the first paper ejection tray 16.

Figure 10:
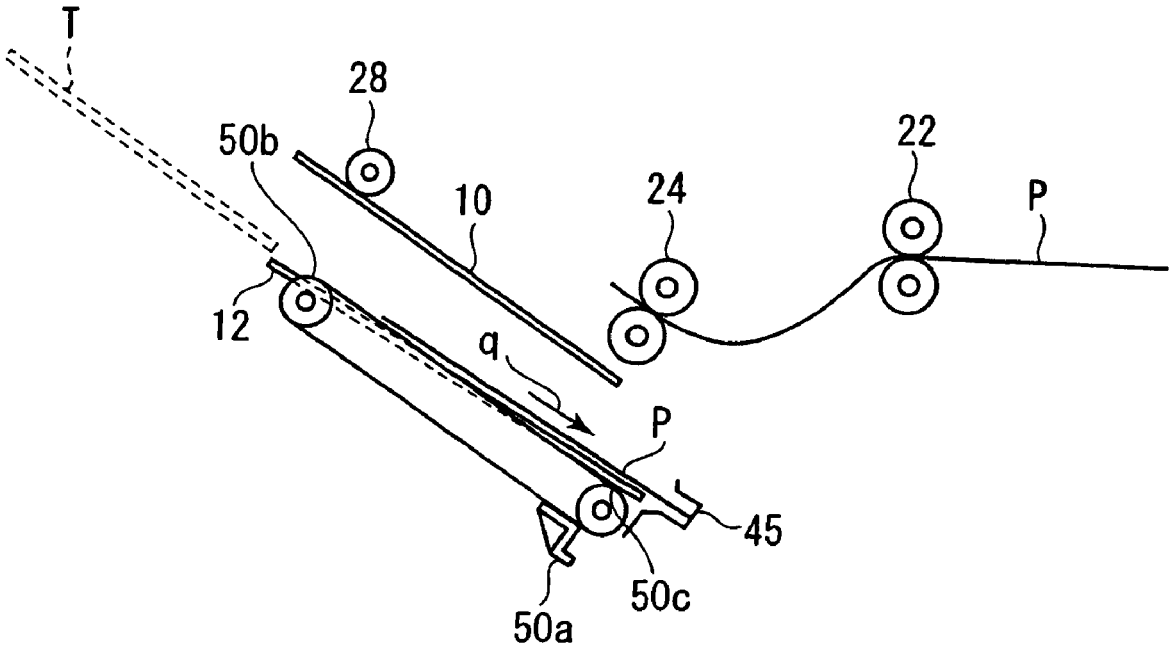
FIG. 10 is an illustration showing the condition that a sheet of paper on the standby tray or paper ejection tray relating to an embodiment of the present invention is pressed out.

In this way, sheets of paper are sequentially loaded on the first paper ejection tray 16. At this time, the first paper ejection tray 16 is arranged at an angle of inclination of θ2 and the front end of each sheet of paper is positioned higher than the rear end thereof, so that for example, even if a sheet of paper P is ejected onto the first paper ejection tray 16 in a state that it is curved convexly as shown by the dotted line in FIG. 10, the sheet of paper P precedingly loaded on the paper ejection tray 16 is not pressed out by contact with the front end of the succeeding sheet of paper P. Namely, the ejected sheet of paper P is sequentially loaded on the first paper ejection tray 16 unless the order is disturbed. Further, even if the preceding sheet of paper P is slightly shifted by being pressed by the succeeding sheet of paper P, the angle of inclination θ2 is provided, so that the sheet of paper P drops by its own weight and is matched and loaded on the first paper ejection tray 16 in the state that the rear end is properly arranged, and the ejection process of the sheets of paper P is completed.

Next, a case that the stapling process which is the post process is to be performed and there is no preceding sheet of paper P during execution of the stapling process on the processing tray 12 will be described. At this time, the standby tray 10 slides and moves the tray members 10*a* and 10*b* respectively up to the positions indicated by the dotted lines shown in FIG. 11 in the direction of the arrow m and the direction of the arrow n and opens the drop and supply path of sheets of paper P. Further, the horizontal matching plates 47*a* and 47*b*, to horizontally match sheets of paper P dropped from the paper supply rollers 24, are arranged so that the interval between the horizontal matching plates 47*a* and 47*b* becomes almost equal to the width of the sheets of paper P. By doing this, the sheets of paper P supplied from the paper supply rollers 24 are directly dropped and supplied onto the processing tray 12 unless the conveyance is interrupted by the standby tray 10.

At the time of drop and supply, the upper vertical matching roller 38*a* is shifted upward and the receiver 44*a* of the paddle 44 receives the rear end of each sheet of paper P. The sheet of paper P drops in a state that both sides thereof are in contact with the horizontal matching plates 47*a* and 47*b* and is matched horizontally. Then, the paddle 44 rotates in the direction of the arrow o and the rear end of the sheet of paper P drops from the receiver 44*a* and is tapped down onto the processing tray 12 by the tapping portion 44*b*. Furthermore, the paddle 44 sends the sheet of paper P in the direction of the arrow q by the feeder 44*c*, and the rear end of the sheet of paper P makes contact with the stopper 45, and the matching of the sheet of paper P in the vertical direction is completed. Further, the vertical matching of sheets of paper P on the processing tray 12 may be executed by the upper vertical matching roller 38*a* by moving it up and down each time.

In this way, the sheets of paper P with an image formed thereon are sequentially matched in the horizontal direction and vertical direction and are loaded directly on the processing tray 12 from the paper supply rollers 24. When the sheets of paper Preach a predetermined number of sheets, the stapler 14 staples and bundles the sheets of paper P on the processing tray 12 at a desired position to form a sheet bundle T. Hereafter, the upper vertical matching roller 38*a* moves down on the sheet bundle, and the sheet bundle T is clamped by the upper vertical matching roller 38*a* rotating in the direction of the arrow r and the lower vertical matching roller 38*b* rotating in the direction of the arrow s and is conveyed toward the first paper ejection tray 16. When the rear end of the sheet bundle T passes the upper and lower vertical matching rollers 38*a* and 38*b*, it is caught by the feeding pawl 50*a* of the conveying belt 50 rotating in the direction of the arrow t and the bundle is sent onto the first paper ejection tray 16.

At this time, the first paper ejection tray 16 slides and moves from the position indicated by the dotted line in FIG. 3 to the position indicated by the solid line. Further, the first paper ejection tray 16 is arranged at an angle of inclination of θ2 and the front end of each sheet of paper is positioned higher than the rear end thereof, so that the sheets of paper P of the bundle precedingly sent onto the first paper ejection tray 16 are not pressed out by contact with the front end of the succeeding sheet bundle T. Further, even if the preceding sheet bundle T is slightly shifted by the succeeding sheets of paper P, the angle of inclination θ2 is provided, so that the sheet bundle T drops by its own weight and is matched and loaded on the first paper ejection tray 16 in the state that the rear ends are properly arranged, and the stapling process of the sheets of paper P is completed.

Next, a case that the stapling process which is the post process is to be performed and a preceding sheet of paper P during execution of the stapling process remains on the processing tray 12 will be described. At this time, the standby tray 10 slides and moves the tray members 10*a* and 10*b* from the positions indicated by the dotted lines shown in FIG. 11 respectively in the opposite direction of the direction of the arrow m and the opposite direction of the direction of the arrow n and can support the sheets of paper P in the positions indicated by the solid lines shown in FIG. 11. Further, the standby tray roller 28 is shifted upward not to disturb the sheets of paper P. Sheets of paper P which are ejected from the image forming apparatus 5 and supplied by the paper supply rollers 24 are loaded once on the standby tray 10 to wait for the processing tray 12 to become empty.

Figure 14B:
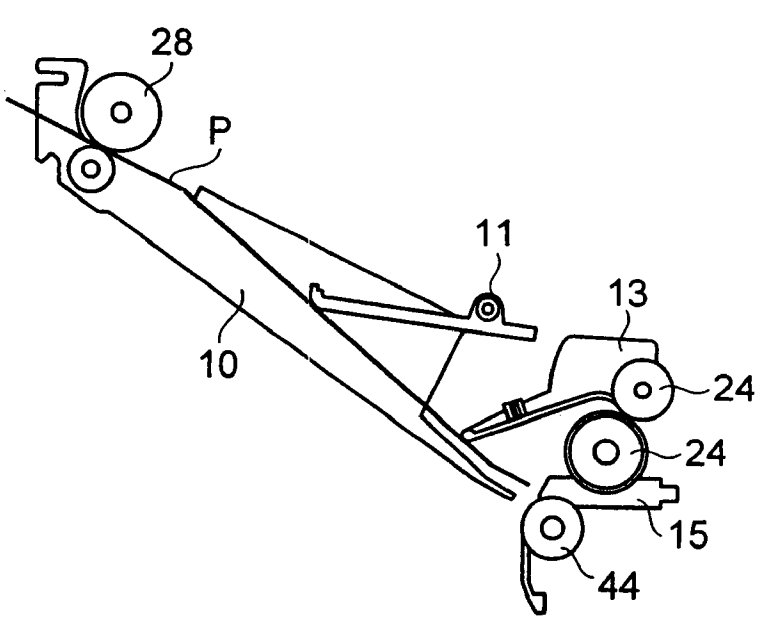
FIGS. 14A and 14B are illustrations showing the consistency of the posture of a sheet of paper positioned by the standby tray guide and assist arm on the standby tray.
Figure 14A:
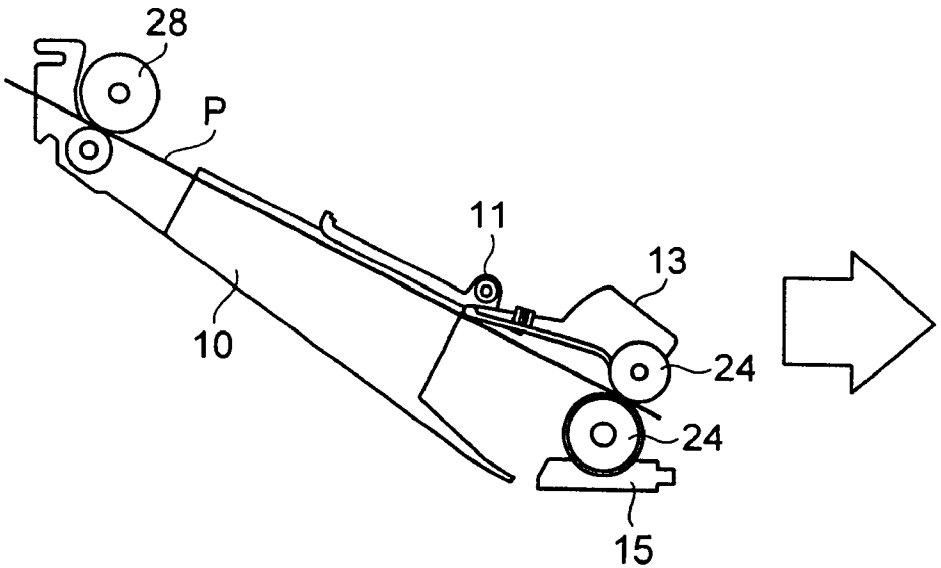

As shown in FIG. 14A, sheets of paper P conveyed powerfully from the paper supply rollers are stiff, so that the assist arm 13 and the standby tray guide 11 are rotated and moved upward (in the clockwise direction in the drawing) Therefore, the sheets of paper P move forward so as to be conveyed as linearly as possible. When the rear end of a sheet of paper P comes off the paper supply rollers 24, as shown in FIG. 14B, the paddle 44 rotates and assists dropping of the rear end of the sheet of paper P. Then, with respect to the assist arm 13 and the standby tray guide 11, the heavy front ends are in contact with the sheet of paper P, so that the rear end of the sheet of paper P is immediately pressed against the standby tray 10. As a result, the rear end of the first sheet of paper P is retained surely by the chuck 15.

The second and subsequent sheets of paper P loaded on the standby tray 10, by the standby tray roller 28 which moves down on the standby tray 10 and rotates in the opposite direction of the direction of the arrow f, are sent toward the standby stoppers 10*c* and 10*d* and are vertically matched in a state that the rear end of each sheet of paper P is in contact with the standby stoppers 10*c* and 10*d*. Furthermore, the standby tray 10 is arranged at an angle of inclination of θ1 and the front end of each sheet of paper is positioned higher than the rear end thereof, so that the rear end of each sheet of paper P makes contact with the standby stoppers 10*c* and 10*d* and the sheets of paper are vertically matched.

Since the sheets of paper P are matched accurately on the standby tray 10 like this, even if a sheet of paper P is supplied from the paper supply rollers 24 in the state that it is curved convexly and supplied onto the standby tray 10, the sheet of paper P precedingly loaded on the standby tray 10 is not pressed out by contact with the front end of the succeeding sheet of paper P. Namely, the supplied sheet of paper P is sequentially loaded on the first paper ejection tray 16 unless the order is disturbed.

Figure 11:
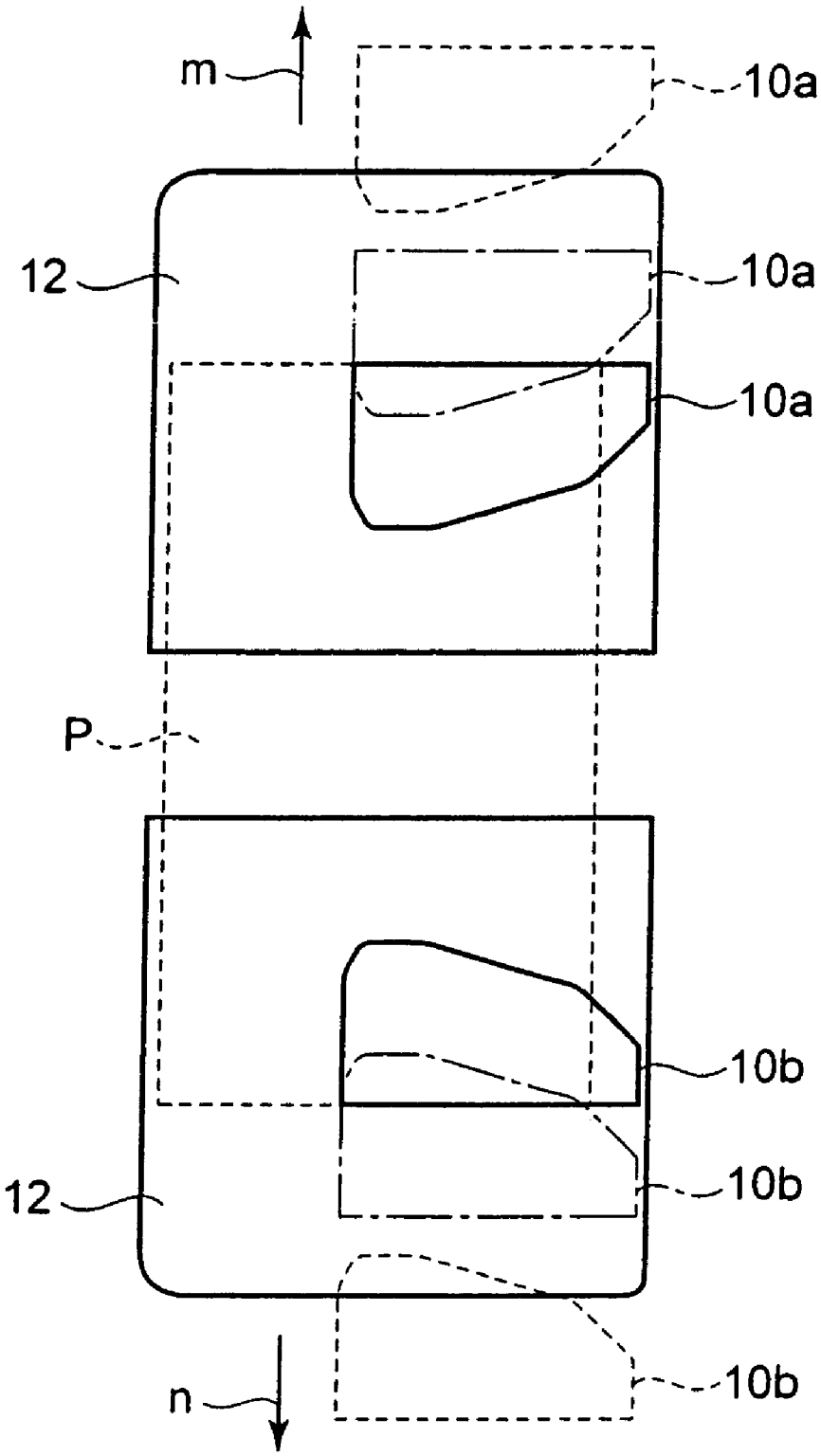
FIG. 11 is an illustration showing movement of the standby tray relating to an embodiment of the present invention.

When the preceding sheet of paper P on the processing tray 12 is ejected on the side of the first paper ejection tray 16 and the processing tray 12 becomes empty, the standby tray 10 slides and moves the tray members 10*a* and 10*b* respectively in the direction of the arrow m and the direction of the arrow n from the positions indicated by the solid lines shown in FIG. 11 via the positions indicated by the alternate long and short dash lines shown in FIG. 11 up to the positions indicated by the dotted lines shown in FIG. 11. By doing this, for example, two sheets of paper P waiting on the standby tray 10, when the tray members 10*a* and 10*b* reach the positions indicated by the alternate long and short dash lines shown in FIG. 11, are dropped and supplied onto the processing tray 12 through the interval between the tray members 10*a* and 10*b*. At this time, the interval between the horizontal matching plates 47*a* and 47*b* is made almost equal to the width of the sheets of paper P. Therefore, the sheets of paper P dropped from the standby tray 10 are matched horizontally with both sides controlled by the horizontal matching plates 47*a* and 47*b*.

The lower side sheet of paper P of the two sheets of paper P dropped on the processing tray 12 is sent in the direction of the arrow q by the lower vertical matching roller 38*b* rotating in the opposite direction of the direction of the arrow s, and the rear end of the sheet of paper P makes contact with the stopper 45, and the vertical matching of the sheet of paper P is completed. The upper side sheet of paper P of the two sheets of paper P dropped on the processing tray 12 is sent in the direction of the arrow q by the upper vertical matching roller 38*a* rotating in the opposite direction of the direction of the arrow r, and the rear end of the sheet of paper P makes contact with the stopper 45, and the vertical matching of the sheet of paper P is completed, and hereafter the upper vertical matching roller 38*a* is shifted upward.

The third and subsequent sheets of paper P ejected from the image forming apparatus 5 are directly dropped and supplied onto the processing tray 12 from the interval between the tray members 10*a* and 10*b* unless they wait on the standby tray 10. Hereafter, the third and subsequent sheets of paper P are sequentially matched on the sheets of paper P loaded on the processing tray 12 before the paddle 44.

When sheets of paper P loaded on the processing tray 12 reach a predetermined number of sheets, the sheets of paper P are stapled by the stapler 14 and a sheet bundle T is formed. Hereafter, the sheet bundle T is conveyed toward the first paper ejection tray 16 by the upper and lower vertical matching rollers 38*a* and 38*b*, and moreover the rear end thereof is caught by the feeding pawl 50*a* of the conveying belt 50, and the bundle is sent onto the first paper ejection tray 16, and the stapling process of the sheets of paper P is completed.

In this embodiment structured like this, there is no need to install an exclusive path for sheets of paper requiring no post process, so that the cost of the sheet finishing apparatus can be decreased. Further, the time up to paper ejection can be shortened compared with paper ejection via the processing tray.

The standby tray 10 is provided with an angle of inclination of θ1, thus sheets of paper P can be matched by their own weight on the standby tray 10, and moreover there is no fear that sheets of paper P loaded precedingly may be pressed out by succeeding sheets of paper P, and the consistent posture of the sheets of paper P on the standby tray 10 can be enhanced, and the sheets of paper P can be prevented from jamming, and moreover the loading order of the sheets of paper P on the standby tray 10 can be prevented from disturbance. Similarly, the first or second paper ejection tray 16 or 18 is provided with an angle of inclination of θ2, thus there is no fear that sheets of paper P or a sheet bundle T loaded precedingly on the first or second paper ejection tray 16 or 18 may be pressed out by succeeding sheets of paper P or sheet bundle T, and the consistent posture of the sheets of paper P on the first or second paper ejection tray 16 or 18 can be enhanced, and the sheets of paper P can be prevented from jamming, and moreover the loading order of the sheets of paper P or sheet bundle T on the first or second paper ejection tray 16 or 18 can be prevented from disturbance.

Further, in the present invention, the post process performed for sheets of paper loaded on the processing tray is the stapling process. However, the post process is not limited to the stapling process and for example, the post process such as a hole punching (hole boring) process performed for sheets of paper is not questionable. In this case, one sheet of paper instead of a plurality of sheets of paper may be loaded unquestionably on the processing tray. Further, needless to say, for a post processing apparatus having such a post processing mechanism, the present invention produces an effect.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet finishing apparatus for post-processing sheets of paper after image forming, comprising:

a pair of paper supply rollers configured to receive and convey sheets of paper ejected from an image forming apparatus;

a standby tray configured to make said sheets of paper ejected from said paper supply rollers stand by;

a processing tray arranged under said standby tray and configured to load said sheets of paper dropped and supplied from said standby tray and/or said sheets of paper ejected from said image forming apparatus not via said standby tray;

a processing mechanism configured to post-process said sheets of paper loaded on said processing tray;

a paper ejection tray configured to load said post-processed sheets of paper ejected from said processing tray;

a standby tray guide extending over the standby tray and configured to control movement and posture of said sheets of paper ejected from said paper supply rollers to said standby tray, the standby tray guide being born rotatably on a side of said standby tray and a front end of the standby tray guide being rounded so as to crush upward curls of said sheets of paper; and an assist arm configured to prevent a rear end side of said sheets of paper conveyed from said paper supply rollers from rising and to press the rear end of said sheets of paper to the standby tray, a side of said assist arm in contact with said sheets of paper having a weight heavier than a weight of the sheets of paper to prevent the sheets of paper from unexpected movement, wherein said standby tray is composed of at least a pair of tray members for respectively supporting both sides of said sheets and configured to slide and move said tray members to drop and feed said sheets onto said processing tray.

2. The sheet finishing apparatus according to claim 1, further comprising a chuck configured to retain said rear ends of said sheets of paper and installed on the downstream side of said standby tray.

3. The sheet finishing apparatus according to claim 1, wherein said standby tray guide is arranged on a left side and on a right side of said sheets of paper almost in accordance with a width of said sheets of paper.

4. The sheet finishing apparatus according to claim 3, wherein said assist arm is arranged between said right side and left side standby tray guides.

5. The sheet finishing apparatus according to claim 3, wherein a plurality of said assist arms each of a similar or same shape is arranged and adjacent assist arms are connected mutually.

6. The sheet finishing apparatus according to claim 1, wherein said assist arm is born rotatably by a mounting shaft of said paper supply rollers.

7. The sheet finishing apparatus according to claim 1, wherein said assist arm is in a lever shape.

8. The sheet finishing apparatus according to claim 1, wherein said processing mechanism is a stapler configured to bundle the plurality of sheets loaded on said processing tray.

9. The sheet finishing apparatus according to claim 1, wherein said paper ejection tray is configured to load said sheets ejected from said standby tray not via said processing tray.

10. A sheet finishing apparatus for post-processing sheets of paper after image forming, comprising:

means for receiving and conveying sheets of paper ejected from an image forming apparatus;

means for making said sheets of paper ejected from said means for receiving and conveying sheets stand by;

means for loading said sheets of paper dropped and supplied from said means for making sheets standby and/or said sheets of paper ejected from said image forming apparatus not via said means for making sheets standby, arranged under said means for making sheets means for post-processing said sheets of paper loaded on said means for loading sheets;

means for loading said post-processed sheets;

means for controlling movement and posture of said sheets of paper ejected from said means for receiving and conveying sheets to said means for making sheets standby, extending over said means for making sheets standby and born rotatably on a side of said means for making sheets standby, having a front end thereof being rounded so as to crush upward curls of said sheets of paper; and means for preventing a rear end side of said sheets of paper conveyed from said means for receiving and conveying from rising by pressing rear ends of said sheets of paper to said means for making sheets standby, a side of the means for preventing a rear end side of said sheets of paper from rising being in contact with said sheets of paper and having a weight heavier than a weight of the sheets of paper to prevent the sheets of paper from unexpected movement, wherein said means for making sheets standby is composed of at least a pair of tray members for respectively supporting both sides of said sheets and slides and moves said tray members to drop and feed said sheets onto said means for loading sheets.

11. The sheet finishing apparatus according to claim 10, wherein further comprising a chuck configured to retain said rear ends of said sheets of paper and installed on the downstream side of said means for making sheets standby.

12. The sheet finishing apparatus according to claim 10, wherein said means for controlling is arranged on a left side and on a right side of said sheets of paper almost in accordance with a width of said sheets of paper.

13. The sheet finishing apparatus according to claim 12, wherein said means for pressing is arranged between said right side and left side means for controlling.

14. The sheet finishing apparatus according to claim 12, wherein a plurality of said means for pressing each of a similar or same shape is arranged and adjacent means for pressing are connected mutually.

15. The sheet finishing apparatus according to claim 10, wherein said means for pressing is born rotatably by a mounting shaft of said means for receiving and conveying sheets.

16. The sheet finishing apparatus according to claim 10, wherein said means for pressing is in a lever shape.

17. The sheet finishing apparatus according to claim 10, wherein said means for post-processing is a stapler configured to bundle the plurality of sheets loaded on said means for loading sheets.

18. The sheet finishing apparatus according to claim 10, wherein said means for loading post-processed sheets loads said sheets ejected from said means for making sheets standby not via said means for loading sheets.

* * * * *